United States Patent [19]

Yasuhara et al.

[11] Patent Number: 4,717,497

[45] Date of Patent: Jan. 5, 1988

[54] TIN-PLATE DEGREASING DETERGENT

[75] Inventors: Kiyotada Yasuhara; Masae Adachi, both of Neyagawa, Japan

[73] Assignee: Amchem Products, Inc., Ambler, Pa.

[21] Appl. No.: 709,634

[22] Filed: Mar. 8, 1985

[30] Foreign Application Priority Data

Mar. 10, 1984 [JP] Japan ..... 59-045990

[51] Int. Cl.[4] ..... C11D 7/16

[52] U.S. Cl. ..... 252/135; 134/40; 252/156; 252/DIG. 14

[58] Field of Search ..... 252/135, 156, 158, 389.2, 252/389.62, DIG. 14; 134/40; 148/6.15 R, 6.17; 106/14.12, 14.21

[56] References Cited

U.S. PATENT DOCUMENTS

| | | | |
|---|---|---|---|
| 2,037,566 | 5/1936 | Durgin | 87/5 |
| 2,142,870 | 1/1939 | Hall et al. | 87/5 |
| 3,007,817 | 11/1961 | Cavanagh et al. | 148/6.15 |
| 3,888,783 | 6/1975 | Rodzewich | 252/135 |
| 3,895,910 | 7/1977 | Juchniewicz | 134/2 |
| 3,975,215 | 9/1976 | Rodzewich | 148/6.17 |
| 4,259,199 | 3/1981 | Wee et al. | 252/99 |
| 4,265,780 | 5/1981 | Kimura et al. | 252/156 |
| 4,311,536 | 1/1982 | Schapira et al. | 148/6.15 R |
| 4,490,181 | 12/1984 | McCready | 134/2 |

FOREIGN PATENT DOCUMENTS

| | | |
|---|---|---|
| 563357 | 9/1958 | Canada . |
| 611543 | 12/1960 | Canada . |
| 1093645 | 11/1960 | Fed. Rep. of Germany . |
| 78457 | 12/1970 | German Democratic Rep. . |
| 346409 | 8/1972 | U.S.S.R. . |
| 455991 | 2/1975 | U.S.S.R. . |
| 667589 | 6/1979 | U.S.S.R. . |
| 726160 | 4/1980 | U.S.S.R. . |

OTHER PUBLICATIONS

Putilova, I. N., et al, "Metallic Corrosion Inhibitors".

*Primary Examiner*—Prince E. Willis

*Attorney, Agent, or Firm*—Ernest G. Szoke; Henry E. Millson, Jr.; Mark A. Greenfield

[57] ABSTRACT

A detergent degreasing composition for DI-process tin-plated cans, comprising an alkali metal or ammonium salt of orthophosphoric acid, an alkali metal salt of nitrous acid, an optional surfactant, sufficient of at least one alkali metal salt of carbonic acid to adjust the pH to 9 to 11, and water.

10 Claims, No Drawings

TIN-PLATE DEGREASING DETERGENT

BACKGROUND OF THE INVENTION

1. Field of the Invention

This invention relates to alkaline detergents for removing lubricants from the surface of tin-plate, particularly from tin cans.

2. Statement of the Related Art

Tin cans have traditionally been manufactured in three pieces, consisting of a can cylinder, a can lid, and a can bottom. There is presently a trend toward manufacturing tin cans in only two pieces, with an integral cylinder and bottom.

These two-piece cans are manufactured by stamping tin plate into a circular form, pressing it into a cup shape, and then putting it through a process called drawing and ironing (referred to below as the "DI process"), in which it is passed through several stages of dies to form the can cylinder and bottom in one body. In doing so, a lubricant consisting of mineral oil, animal or vegetable oil, surface active agents, oil property enhancers, extreme-pressure additives, etc., is used to protect the surfaces of the dies and the can and to make the DI process function easily. The DI-process tin-plated can is ordinarily degreased and then chemically treated, after which, if desired, it is painted. In the degreasing, an alkaline degreaser is generally used. If a degreasing detergent with a strong alkaline builder is used to thoroughly remove the above-mentioned lubricant, a sufficient degreasing detergent effect may be obtained, however, one also invites dissolution of the tin on the can surface, the tin-steel alloy, or the steel substrate itself. This not only damages the appearance of the can surface, but can also result in poor corrosion resistance even when subsequent chemical treatment and painting are performed, so that it becomes useless as a container for foods, drinks, etc.

Various cleaning compositions for tin-plate or other metal surfaces are known in the art, including the following, listed in numerical order.

U.S. Pat. No. 2,037,566—Durgin discloses a cleaner composition for tin comprising at least one of trisodium phosphate, sodium carbonate, sodium metasilicate, borax, or soap powder in combination with an alkali metal perborate as well as an alkaline earth metal salt and/or an alkali metal silicate.

U.S. Pat. No. 2,142,870—Hall, et al., discloses a composition cleaner for tinned surfaces comprising trisodium phosphate and sodium carbonate or sodium sesquicarbonate. Sodium bicarbonate is excluded.

U.S. Pat. No. 3,007,817—Cavanagh, et al., discloses cold cleaning a metal surface prior to a phosphate coating using an alkaline cleaning composition comprising alkali metal orthophosphates and borates, sodium being preferred. Sodium nitrite and an octylphenoxy ethanol surfactant may also be present in the cleaner.

U.S. Pat. No. 3,888,783—Rodzewich and its divisional, U.S. Pat. No. 3,975,215 disclose a cleaner composition for tin-plated ferrous metal cans comprising an alkali metal metasilicate, an alkali metal condensed phosphate, borax, and optional surfactants and wetting agents, preferably nonionic.

U.S. Pat. No. 4,259,199—Wee, et al., discloses an alkaline dishwasher detergent composition comprising a sodium or potassium tripolyphosphate, sodium or potassium carbonate to raise the reserve alkalinity, sodium or potassium silicates, a chlorine source such as sodium dichlorocyanurate dihydrate, a nonionic surfactant, and other minor ingredients.

U.S. Pat. No. 4,265,780—Kimura, et al., discloses an alkaline cleaner composition for tin cans comprising a myoinositol ester, an alkaline builder which may be at least one of sodium secondary phosphate, sodium tertiary phosphate, sodium carbonate (soda ash), sodium bicarbonate, and the like, and a surfactant.

U.S. Pat. No. 4,490,181—McCready discloses an alkaline cleaner composition for tin cans having a pH of 11 to 13 and comprising an alkaline component which is at least one of alkali metal hydroxides, carbonates, and silicates and ammonium hydroxides and carbonates with an etching inhibitor which is a substituted benzene, a quinone, or a substituted quinone.

Canadian Pat. No. 563,357—Arnold, et al., discloses a non-ferrous metal cleaner composition preferably having a pH of 9 to 11 comprising soda ash, sodium tripolyphosphate, tri- and mono- sodium phosphate, sodium nitrite, and a nonionic surfactant, among others.

Japanese published application No. 57-15,670 discloses a nitrite as one ingredient in an alkaline degreasing composition for metal surfaces. The nitrite is identified as an oxidant, the group of oxidants including a bromate, chlorate, iodate, chromate, vanadate, permanganate, etc.

SUMMARY OF THE INVENTION

This invention affords a degreasing detergent for tin-plated cans or other tin-surface objects, comprising an aqueous solution containing (a) at least 1.5 g/l of an alkali metal or ammonium salt of orthophosphoric acid and (b) at least 0.5 g/l of an alkali metal salt of nitrous acid. The mol ratio of a:b is 1–3.86:1. The solution has a pH of 9 to 11, which may be adjusted using an alkali metal salt of carbonic acid. A surfactant may be present, which preferably is nonionic.

In preferred embodiments, the salt of orthophosphoric acid is sodium secondary phosphate or sodium tertiary phosphate, the salt of nitrous acid is sodium nitrite, the salt of carbonic acid is soda ash (crude sodium carbonate) and/or sodium bicarbonate, and the mol ratio of a:b is 1.46–2.43:1.

Other than in the operating examples, or where otherwise indicated, all numbers expressing quantities of ingredients or reaction conditions used herein are to be understood as modified in all instances by the term "about".

DESCRIPTION OF THE PREFERRED EMBODIMENTS

As the alkali metal salt (e.g., Na salt, K salt) or ammonium salt of orthophosphoric acid, sodium secondary or tertiary phosphate is preferred, the secondary phosphate being most preferred. This ingredient must be present in at at least 1.5 g/l. If the minimum quantity is not present, the degreasing-detergent ability is low, and the aim of this invention cannot be accomplished (see Comparison Examples C-5 and C-6 below). There is no particular upper limit, but from the point of view of economy, it should be 10 g/l or less. A range of 1.5 to 4 g/l is preferred and a range of 3 to 4 g/l is most preferred.

As the alkali metal salt (e.g., Na salt, K salt) of nitrous acid, sodium nitrite is preferred. This ingredient must be present in at at least 0.5 g/l. If the minimum quantity is not present, there is an increased possibility of dissolving the tin of the tin plate, the tin-steel alloy, or the steel substrate, and the corrosion resistance when the can is still unpainted becomes poor (see Comparison Examples C-3 and C-4 below). The upper limit is not particularly critical, but from the point of view of economy, it should be 2 g/l or less. The presence of 1 g/l is preferred. The choice of a nitrite is important. If some of the other oxidants disclosed in the prior art are used, such as a bromate chlorate, or iodate, and if the oxidant is left on the surface of the tin can being cleaned, it will cause very undesirable pinhole corrosion. It is not desirable to treat the cans with oxidants containing heavy metals, such as chromates, vanadates, or permanganates, if they are to be used for foods, drinks, etc. However, in the case of nitrites, there is little possibility of their remaining on the can surface. Even if the nitrites do remain, pinhole corrosion is not produced, and there is no adverse effect on nonchromium chemical treatments.

In the degreasing composition of this invention it is necessary for the above-mentioned two required ingredients to be compounded in specific ratios. That is, the orthophosphate:nitrite molar ratio must be 1–3.86:1, preferably 1.46–2.43:1, most preferably 1.46–1.94:1. If the proportion of the orthophosphate is too low, the degreasing detergent effect is reduced; if it is too high, the solubility of the above-mentioned metals becomes large. In either case, corrosion resistance after painting is insufficient (see Comparison Examples C-7 and C-8 below).

The degreasing agent of this invention, which is an aqueous solution of the above-mentioned necessary ingredients in specific proportions, must have a pH in the range of 9–11. If the pH is lower than this, the degreasing detergent effect is reduced; if it is higher, the solubility of the above-mentioned metals becomes large, and the corrosion resistance when the can is unpainted is especially reduced (see Comparison Examples C-1 and C-2 below).

The above-mentioned pH regulation is performed by adding sufficient of an alkali metal salt (e.g., Na salt, K salt) of carbonic acid. The use of soda ash and/or sodium bicarbonate is particularly desirable. When sodium secondary phosphate is used as the orthophosphate, it is desirable to use soda ash and sodium bicarbonate; when sodium tertiary phosphate is used, it is desirable to use sodium bicarbonate; and when sodium primary phosphate or ammonium primary phosphate is used, it is desirable to use soda ash. Within the above pH limitations, the preferred amount of soda ash is 1.3 to 3 g/l (especially 1.5 to 2.5 g/l) and the preferred amount of sodium bicarbonate is 2.5 to 5.0 g/l (especially 2.5 to 2.7 g/l). The preferred combined amount is 4 to 5.5 g/l (especially 4 to 5 g/l).

As builders for alkali-degreasing of metal surfaces, caustic soda, silicates (sodium metasilicate, etc), borates (borax, etc), condensed phosphates (sodium tripolyphosphate, etc.), and the like, are generally well known. However, using caustic soda will increase the dissolution of the tin-plate material, and corrosion resistance either after painting or without painting will be poor. Moreover, there is the disadvantage that the pH of the degreasing agent is hard to control. With silicates, painting becomes difficult (especially with spray guns). With borates, metal dissolution increases due to the water quality, and stable treatment rates are difficult to achieve. With condensed phosphates (especially tripolyphosphates), the metal dissolution is large, and the same problems as with caustic soda are produced. Consequently, if pH regulation of the degreasing agent is performed with these alkali builders, the purpose of this invention cannot be accomplished (see Comparison Examples C-9, C-10, and C-11, below).

In the degreasing agent of this invention, in order to further increase the degreasing detergent ability, one can, if desired, add surfactants which are well-known in this field, in the proportion of 0 to 1 g/l, preferably 0.1–1 g/l, most preferably 0.2–0.5 g/l. If the quantity added is too small, there is no increase in detergent capability, while if it is too great, there is excessive foaming and it is also not economically advantageous. Examples of useful surfactants are: polyoxyethylene alkyl ester, coconut oil natural alcohol ethoxylate, polyoxyethylene alkylether, polyoxyethylene sorbitan alkyl ester, N-polyoxyethylene alkyl amine, modified fatty acid alkanolamide etc. Nonionics are particularly suitable for use, especially polyoxyethylene alkyl ether and polyoxylethylene alkyl ester.

The degreasing agent of this invention may be prepared by known methods; e.g., prescribed quantities of orthophosphate and nitrite can be compounded in water, and the pH of the aqueous solution can then be regulated to the prescribed value while mixing in the carbonate. The degreasing detergent treatment is ordinarily performed at 40°–80° C., preferably 60° C., by the immersion or spray methods. The spray method is generally the most suitable. The spray treatment time may be 30 to 120 seconds, preferably 60 seconds, usually followed by a water wash.

With the degreasing agent of this invention, as described above, tin-plated cans for foods, drinks, etc., can be degreased and thoroughly washed without much dissolution of tin, tin-steel bond, or steel substrate, and sufficient corrosion resistance can be accomplished by subsequent non-chromium-type chemical treatment and painting. Of course, when chromium-type chemical treatment is permitted, the same purpose can also be accomplished by utilizing this invention.

EXAMPLES 1–9

Cans of DI-process tin-plated steel plate of apparent quantity #50/#50 were, using the spray method, (a) degreased-treated using aqueous solutions with the compositions shown in Table 1 below (60° C., 60 seconds), (b) washed with water (15 seconds), (c) chemically treated with a commercial non-chromium-type phosphating agent (Nippon Paint Co., Ltd.) (60°–70° C., 30 seconds), (d) washed with water (15 seconds), (e) washed with deionized water (5 seconds), and then dried at 100° C. for 3 minutes. Next, the inner surfaces of the chemically treated cans were painted with epoxy paint (Nippon Paint Co., Ltd.) with a film thickness of approximately 5μ, and after setting for 8 minutes the coating was baked at 200° C. for 5 minutes.

In Example 7, sodium tertiary phosphate was used as the orthophosphate, and in the other examples, sodium secondary phosphate was used. For the surfactant, an alkyl phenyl ethoxylate type was used.

The following tests were performed on the cans treated by the above process; the results are shown in Table 1.

(1) Water break test: The water break rate (%) was evaluated visually after 30 seconds, after the cans were degreased and washed with water and left standing upended. A break rate of 100% is preferred (indicating complete degreasing), 95% being acceptable.

(2) Etching test: After first washing with acetone to remove the oil, dirt, etc. on them, the cans were weighed; next, the cans were degreased (treated for 15 minutes), and then, after washing with water and drying, they were weighed again. The etching quantity (loss) ($mg/m^2$) of the cans was obtained from the difference in weights before and after. An etching quantity of above 50 $mg/m^2$ is unacceptable.

(3) Unpainted corrosion resistance test: Into the test solution (40 g sodium chloride, 30 g potassium ferricyanate, and 1 g fluorine-type surfactant were dissolved in deionized water, and the total quantity was made up to 1 l; this was filtered with No. 2 filter paper) were immersed No. 52 filter papers (1 cm×7 cm). The papers were removed and immediately applied for 2 minutes to the inside surfaces of cans which had been chemically treated, washed with water, and dried. Next, the filter papers were thoroughly washed and dried, and their degrees of blue discoloration were evaluated. The stronger the degree of discoloration, the more it is shown that the corrosion resistance is not good.

+: almost no discoloration—slight discoloration (acceptable)

−: small amount of discoloration (unacceptable)

x: discoloration (unacceptable)

(4) Paint adhesion test: The side surfaces of the painted cans were cut into test pieces, 5 cm×10 cm. These test pieces were immersed for 30 minutes in a boiling 5% aqueous solution of acetic acid, washed with water and dried. Next, 100 checkerboard squares 2 mm×2 mm were cut in the painted surface of the test pieces with a sharp knife, until the bare surface was reached. After an adhesive tape was strongly pressed onto this, it was violently torn off. The peeling of the paint film was evaluated. At least 91% of the paint squares must remain coated for an acceptable result.

+: 91% or more squares of paint film remained

−: 51% to less than 91% of squares of paint film remained x: less than 51% of squares of paint film remained

COMPARISON EXAMPLES C-1 to C-8

The same operations were performed as in Example 1, except that the degreasing was performed with aqueous solutions with the compositions shown in Table 1, and the results shown in Table 1 were obtained. In all examples sodium secondary phosphate was used as the orthophosphate, and the same surface active agent as in the actual examples were used.

COMPARISON EXAMPLES C-9 to C-11

The same operations were performed as in Example 1, except that the degreasing was performed with aqueous solutions with the compositions shown in Table 1, and the results shown in Table 1 were obtained. Furthermore, the same orthophosphate and surface active agent as in Comparison Examples C-1 to C-8 were used; as the other alkaline builder, sodium metasilicate was used in Comparison Example C-9, borax in Comparison Example C-10, and caustic soda in Comparison Example C-11.

TABLE 1

| | Composition (g/l) | | | | | | | | Testing Results | | | |
|---|---|---|---|---|---|---|---|---|---|---|---|---|
| Example | Sodium Secondary Phosphate (a) | Sodium Nitrite (b) | Mol Ratio a:b | Soda Ash | Sodium Bicarbonate | Alkaline Builder | Surfactant | pH | Water Break Test (%) | Etching Weight ($mg/m^2$) | Corrosion Resistance | Coating Adhesiveness |
| 1 | 1.5 | 0.5 | 1.46:1 | 1.3 | 2.7 | — | 0.5 | 9.3 | 100 | 31 | + | + |
| 2 | 3.0 | 1.0 | 1.46:1 | 1.4 | 2.6 | — | 0.5 | 9.4 | 100 | 28 | + | + |
| 3 | 4.0 | 1.0 | 1.94:1 | 1.4 | 2.6 | — | 0.5 | 9.3 | 100 | 29 | + | + |
| 4 | 10.0 | 2.0 | 2.43:1 | 1.5 | 2.5 | — | 0.5 | 9.5 | 100 | 35 | + | + |
| 5 | 3.0 | 1.0 | 1.46:1 | 1.4 | 2.6 | — | — | 9.4 | 95 | 36 | + | + |
| 6 | 4.0 | 1.0 | 1.94:1 | 1.5 | 2.5 | — | — | 9.7 | 100 | 27 | + | + |
| 7 | 4.0* | 1.0 | 1.68:1 | — | 5.0 | — | 0.5 | 9.6 | 100 | 44 | + | + |
| 8 | 4.0 | 1.0 | 1.94:1 | 2.5 | 2.5 | — | 0.5 | 9.8 | 100 | 32 | + | + |
| 9 | 4.0 | 1.0 | 1.94:1 | 3.0 | 2.5 | — | 0.5 | 10.5 | 100 | 42 | + | + |
| C-1 | 4.0 | 1.0 | 1.94:1 | — | 5.0 | — | 0.5 | 8.4 | 90 | 17 | + | − |
| C-2 | 4.0 | 1.0 | 1.94:1 | 5.0 | — | — | 0.5 | 11.5 | 100 | 153 | × | + |
| C-3 | 4.0 | — | — | 1.5 | 2.5 | — | 0.5 | 9.6 | 100 | 137 | − × | + |
| C-4 | 4.0 | 0.2 | 9.72:1 | 1.5 | 2.5 | — | 0.5 | 9.6 | 100 | 98 | − | + |
| C-5 | — | 1.0 | — | 1.5 | 2.5 | — | 0.5 | 9.8 | 80 | 37 | + | − |
| C-6 | 0.5 | 1.0 | 0.24:1 | 1.5 | 2.5 | — | 0.5 | 9.8 | 90 | 25 | + | − |
| C-7 | 2.0 | 2.0 | 0.49:1 | 1.5 | 2.5 | — | 0.5 | 9.7 | 95 | 29 | + | − |
| C-8 | 7.0 | 0.5 | 6.80:1 | 1.5 | 2.5 | — | 0.5 | 9.5 | 100 | 124 | − | − |
| C-9 | 4.0 | 1.0 | 1.94:1 | — | 3.5 | 0.5 | 0.5 | 10.2 | 100 | 62 | − | × |
| C-10 | 4.0 | 1.0 | 1.94:1 | 2.0 | — | 5.0 | 0.5 | 9.8 | 95 | 78 | − | + |
| C-11 | 4.0 | 1.0 | 1.94:1 | — | 10.0 | 0.5 | 0.5 | 9.9 | 100 | 312 | × | × |

*Sodium Tertiary Phosphate

We claim:

1. A degreasing detergent composition for tin consisting of an aqueous alkaline solution of:
   (a) at least 1.5 g/l of an alkali metal salt or ammonium salt of orthophosphoric acid;
   (b) at least 0.5 g/l of an alkali metal salt of nitrous acid; the mol ratio of a:b being about 1–3.86:1;
   (c) 0 to 1 g/l of a nonionic surfactant;
   (d) sufficient of at least one alkali metal salt of carbonic acid to adjust the pH of said solution to 9 to 11; and
   (e) water, q.s.

2. The composition of claim 1 wherein component (c) is present in a least 0.1 g/l.

3. The composition of claim 1 wherein component (a) is present in about 1.5 to 10 g/l and component (b) is present in about 0.5 to 2.0 g/l.

4. The composition of claim 2 wherein component (a) is present in about 1.5 to 10 g/l, component (b) is present in about 0.5 to 2.0 g/l, and component (c) is present in about 0.2 to 0.5 g/l.

5. The composition of claim 1 or 4 wherein the mol ratio of a:b is about 1.46–2.43:1.

6. The composition of claim 1 or 2 wherein component (a) is sodium secondary phosphate or sodium tertiary phosphate.

7. The composition of claim 1 or 2 wherein component (b) is sodium nitrite.

8. The composition of claim 1 or 2 wherein component (d) is soda ash and/or sodium bicarbonate.

9. The composition of claim 3 or 4 wherein component (a) is sodium secondary phosphate or sodium tertiary phosphate, component (b) is sodium nitrite, and component (d) is soda ash and/or sodium bicarbonate.

10. A method of degreasing DI-process tin-plated cans comprising: treating a DI-process tin-plated can by spraying it with, or immersing it in, a detergent composition for about 30 to 120 seconds at a temperature of about 40° to 80° C., said detergent composition consisting of (a) at least 1.5 g/l of an alkali metal salt or ammonium salt of orthophosphoric acid;

(b) at least 0.5 g/l of an alkali metal salt of nitrous acid; the mol ratio of a:b being about 1–3.86:1;

(c) 0 to 1 g/l of a nonionic surfactant;

(d) sufficient of at least one alkali metal salt of carbonic acid to adjust the pH of said detergent composition to 9 to 11; and (e) water, q.s.

* * * * *